US010655629B2

(12) United States Patent
Kim

(10) Patent No.: US 10,655,629 B2
(45) Date of Patent: May 19, 2020

(54) VARIABLE VANE APPARATUS

(71) Applicant: HANWHA AEROSPACE CO., LTD., Changwon-si (KR)

(72) Inventor: Jong Goo Kim, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 127 days.

(21) Appl. No.: 15/840,613

(22) Filed: Dec. 13, 2017

(65) Prior Publication Data

US 2018/0163735 A1 Jun. 14, 2018

(30) Foreign Application Priority Data

Dec. 14, 2016 (KR) ..... 10-2016-0170407

(51) Int. Cl.

| | |
|---|---|
| ***F04D 27/00*** | (2006.01) |
| ***F04D 29/30*** | (2006.01) |
| ***F04D 17/10*** | (2006.01) |
| ***F04D 29/46*** | (2006.01) |

(52) U.S. Cl.

CPC ..... *F04D 27/002* (2013.01); *F04D 17/10* (2013.01); *F04D 29/30* (2013.01); *F04D 29/462* (2013.01); *F05D 2250/411* (2013.01); *F05D 2260/53* (2013.01); *F05D 2260/72* (2013.01)

(58) Field of Classification Search

CPC ..... F04D 27/002; F04D 29/46; F04D 29/466
See application file for complete search history.

(56) References Cited

U.S. PATENT DOCUMENTS

| | | | | |
|---|---|---|---|---|
| 2,382,913 A * | 8/1945 | Robinson | F04D 29/287 415/148 |
| 2,388,208 A * | 10/1945 | Foss | F01D 17/162 415/160 |
| 3,025,036 A * | 3/1962 | Kumm | F01D 21/006 415/23 |
| 3,816,021 A * | 6/1974 | Lewis | F01D 1/30 415/147 |
| 4,657,476 A | 4/1987 | Berg | |
| 4,726,744 A | 2/1988 | Arnold | |
| 7,186,077 B2 | 3/2007 | Daudel et al. | |

FOREIGN PATENT DOCUMENTS

| | | |
|---|---|---|
| JP | 2006-63895 A | 3/2006 |
| JP | 2010-31735 A | 2/2010 |
| JP | 4900261 B2 | 3/2012 |
| KR | 2002-0094276 A | 12/2002 |

* cited by examiner

*Primary Examiner* — Christopher Verdier
*Assistant Examiner* — Juan G Flores
(74) *Attorney, Agent, or Firm* — Sughrue Mion, PLLC

(57) ABSTRACT

There is provided a variable vane apparatus including: a housing portion; a plurality of vane gear portions configured to rotate and provided on the housing portion to be spaced apart from one another; a plurality of variable vane portions connected to the plurality of vane gear portions; a drive gear portion configured to transfer power to the plurality of vane gear portions; and a connection gear portion arranged between the plurality of vane gear portions and configured to transfer power amongst the plurality of vane gear portions.

11 Claims, 5 Drawing Sheets

VARIABLE VANE APPARATUS

CROSS-REFERENCE TO THE RELATED APPLICATION

This application claims priority from Korean Patent Application No. 10-2016-0170407, filed on Dec. 14, 2016, in the Korean Intellectual Property Office, the disclosure of which is incorporated herein by reference in its entirety.

BACKGROUND

1. Field

Apparatuses consistent with exemplary embodiments relate to a variable vane apparatus.

2. Description of the Related Art

A technique has been known in which a variable vane capable of adjusting a flow of fluid, by adjusting an angle of a variable vane, in a fluid machine is installed in a duct and the flow of fluid is controlled by adjusting the angle of the variable vane.

A variable vane apparatus is a device used for adjusting the angle of the variable vane by an operator or an operating system (e.g., a computer) to control the flow of fluid. The variable vane apparatus is mainly applied to fluid machines such as compressors, turbines, expanders, nozzle devices, etc. to improve performance and to expand an operating range of the fluid machine. In the related art, the variable vane apparatus includes a ring gear and a plurality of quad gears meshed with teeth, where the plurality of quad gears are formed on the inner periphery of the ring gear. In this case, when the ring gear is rotated, the plurality of quad gears connected to the variable vane rotate, and thus the angle of the variable vane is adjusted.

SUMMARY

One or more exemplary embodiments include a variable vane apparatus having a simple structure.

Additional aspects of the disclosure will be set forth in part in the description which follows and, in part, will be apparent from the description, or may be learned by practice of the presented exemplary embodiments.

According to an aspect of an exemplary embodiment, there is provided a variable vane apparatus including: a housing portion; a plurality of vane gear portions rotatably provided on the housing portion to be spaced apart from each other; a variable vane portion connected to each of the plurality of vane gear portions; a drive gear portion transferring power to the vane gear portion and rotatably provided on the housing portion; and a connection gear portion arranged between the plurality of vane gear portions and transferring power between the plurality of vane gear portions.

The housing portion may have a circular ring shape.

The vane gear portion, the variable vane portion, and the connection gear portion may be arranged in a circumferential direction of the housing portion.

The vane gear portion, the drive gear portion, and the connection gear portion may be provided at a rear surface side of the housing portion.

The vane gear portion may be provided on the housing portion via a vane gear rotary shaft.

The variable vane portion may be provided at a front surface side of the housing portion, and provided by being connected to the vane gear rotary shaft.

The variable vane apparatus may further include a drive portion that transfers power to the drive gear portion.

The vane gear portion may have a circular shape and the connection gear portion may have a circular shape.

According to an aspect of an exemplary embodiment, there is provided a variable vane apparatus including: a housing portion; a plurality of vane gear portions configured to rotate and provided on the housing portion to be spaced apart from one another; a plurality of variable vane portions connected to the plurality of vane gear portions; a drive gear portion configured to transfer power to the plurality of vane gear portions; and a connection gear portion arranged between the plurality of vane gear portions and configured to transfer power amongst the plurality of vane gear portions.

The housing portion may have a circular ring shape.

The plurality of vane gear portions, the plurality of variable vane portions, and the connection gear portion may be arranged in a circumferential direction of the housing portion.

The plurality of vane gear portions, the drive gear portion, and the connection gear portion may be provided at a rear surface side of the housing portion.

Each of the plurality of vane gear portions may be provided on the housing portion via a vane gear rotary shaft.

Each of the plurality of variable vane portions may be provided at a front surface side of the housing portion, and are connected to the vane gear rotary shaft.

The variable vane apparatus may further include a drive portion configured to transfer power to the drive gear portion.

Each of the plurality of vane gear portions may have a circular shape and the connection gear portion may have a circular shape.

According to an aspect of an exemplary embodiment, there is provided a variable vane apparatus including: a housing portion; a plurality of variable vanes provided on a first surface of the housing portion and including: a first variable vane; and a second variable vane; a plurality of vane gears provided on a second surface opposite to the first surface of the housing portion and including: a first vane gear connected to the first variable vane via a first gear rotary shaft; and a second vane gear connected to the second variable vane via a second gear rotary shaft; a drive gear connected to the first vane gear and configured to transfer power to the first vane gear; and a connection gear arranged between the first and second vane gears and configured to transfer power from the first vane gear to the second vane gear.

The plurality of vane gears, the plurality of variable vanes, and the connection gear may be arranged in a circumferential direction of the housing portion.

The first vane gear, the connection gear and the second vane gear may simultaneously rotate in response to rotation of the drive gear.

BRIEF DESCRIPTION OF THE DRAWINGS

The above and/or other aspects of the disclosure will become apparent and more readily appreciated from the following description of the exemplary embodiments, taken in conjunction with the accompanying drawings in which.

DETAILED DESCRIPTION

Figure 1:
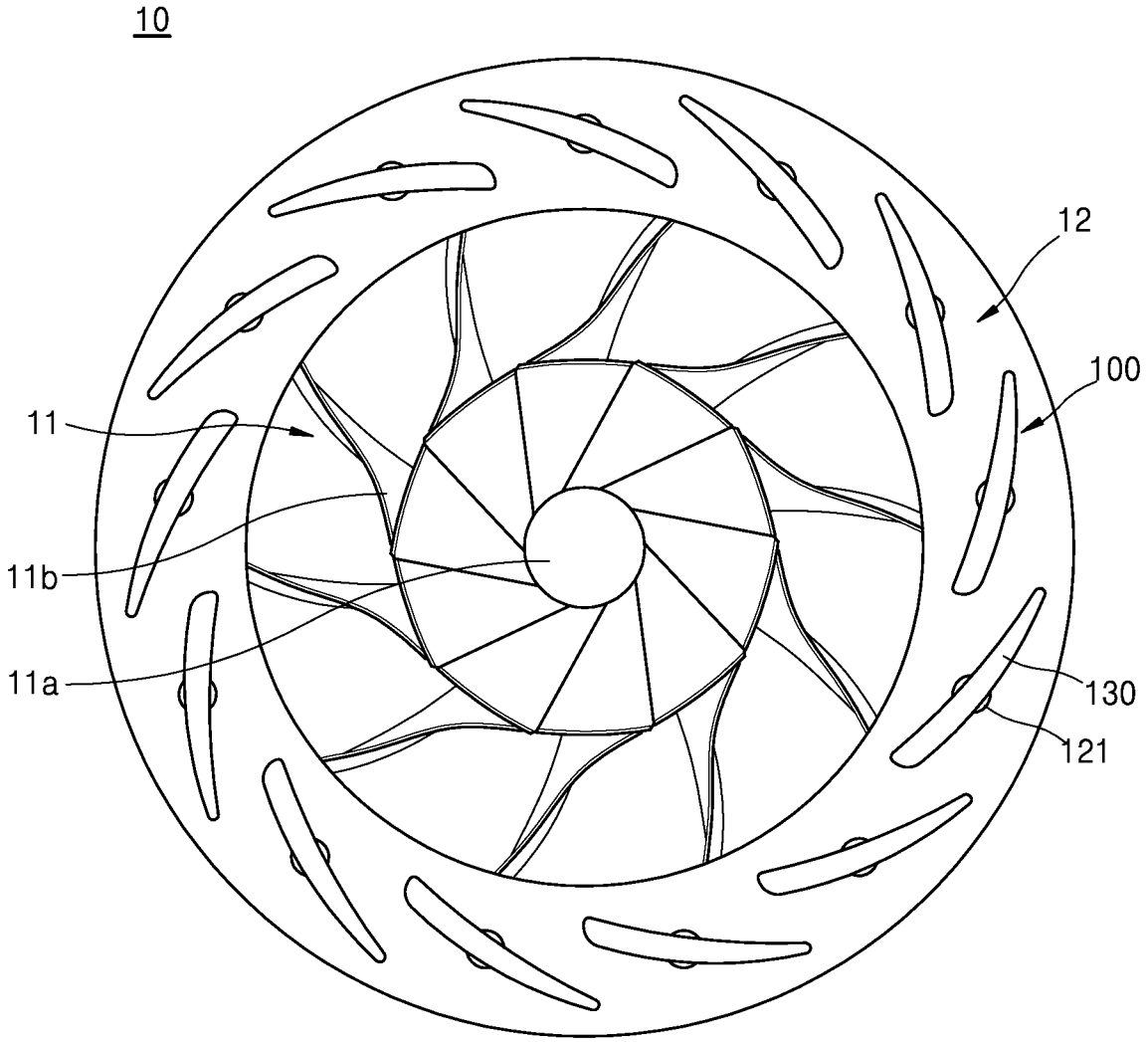
FIG. 1 is a schematic plan view of a centrifugal compressor in which a variable vane apparatus according to an exemplary embodiment is applied to a diffuser portion of the centrifugal compressor.

Reference will now be made in detail to exemplary embodiments, examples of which are illustrated in the accompanying drawings, wherein like reference numerals refer to like elements throughout. In this regard, the exemplary embodiments may have different forms and should not be construed as being limited to the descriptions set forth herein. Accordingly, the exemplary embodiments are merely described below, by referring to the figures, to explain aspects of the present description.

Figure 2:
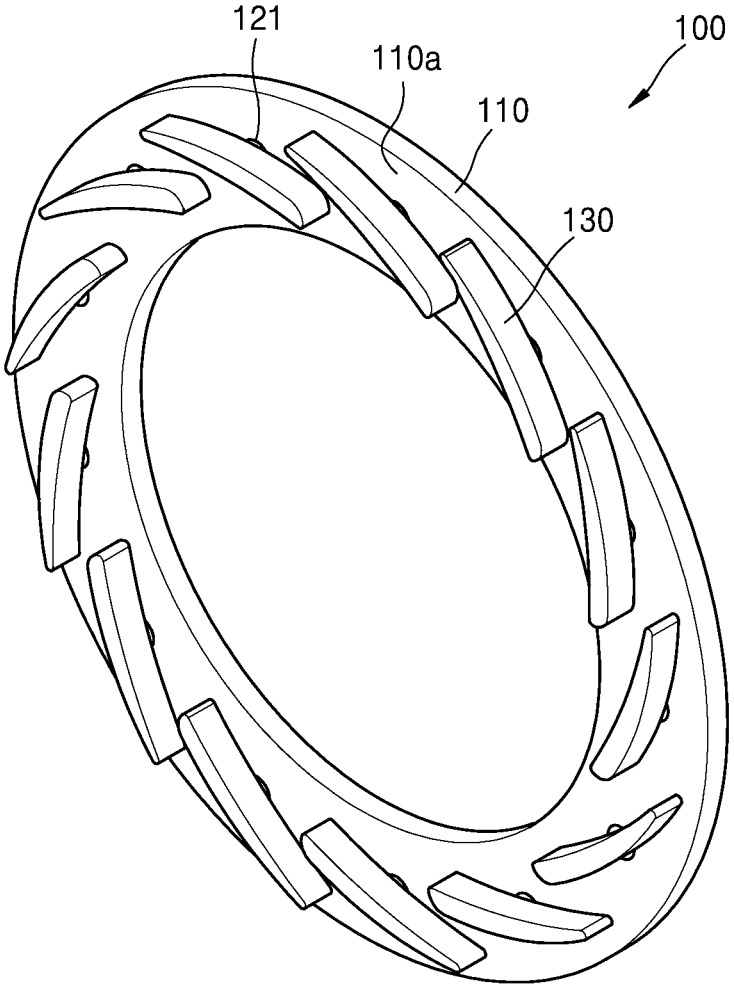
FIG. 2 is a schematic perspective view illustrating a front surface side of the variable vane apparatus according to an exemplary embodiment.
Figure 3:
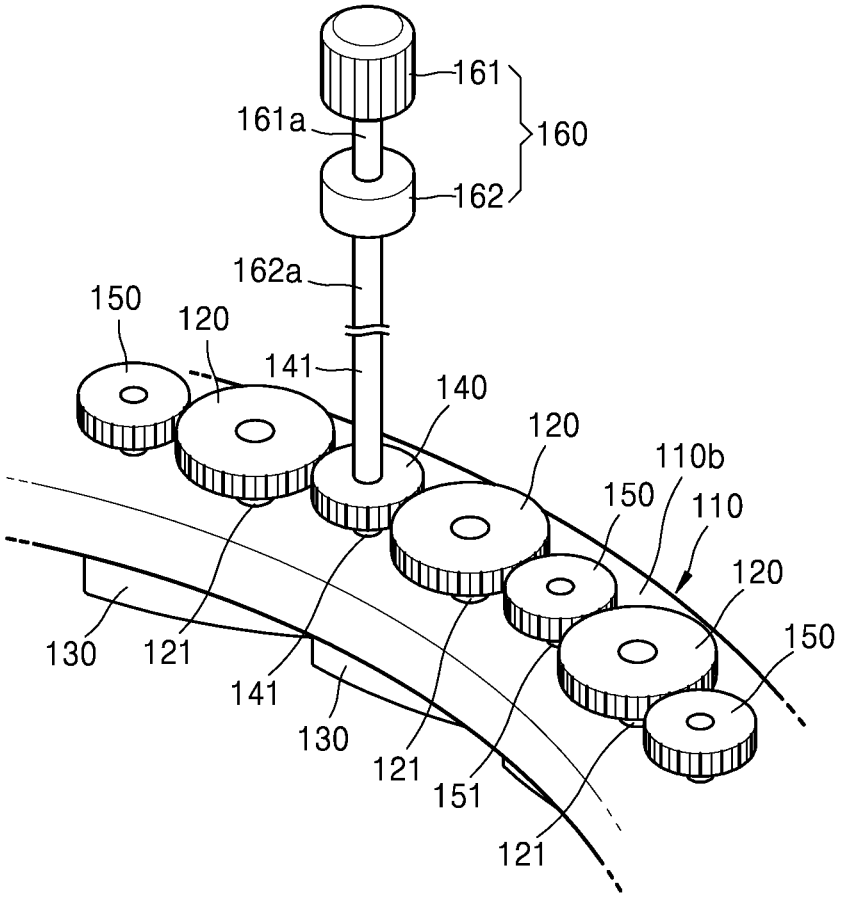
FIG. 3 is a partially perspective view schematically illustrating a portion of a rear surface side of the variable vane apparatus according to an exemplary embodiment.
Figure 4:
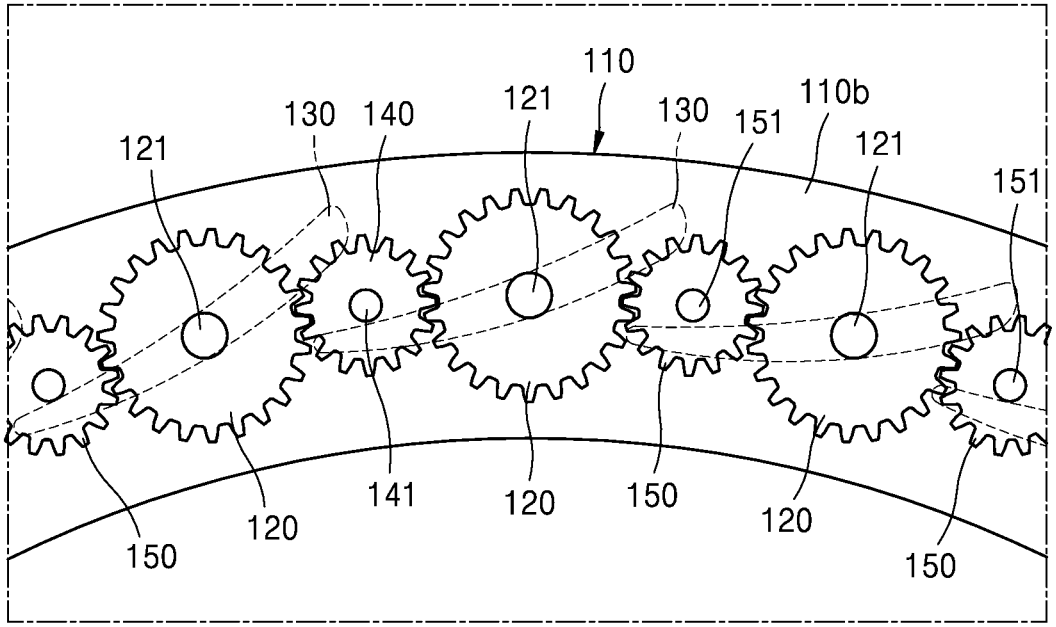
FIG. 4 is a schematic plan view illustrating an arrangement of a vane gear portion, a drive gear portion, and a connection gear portion of the variable vane apparatus according to an exemplary embodiment.

FIG. 1 is a schematic plan view of a centrifugal compressor 10 in which a variable vane apparatus 100 according to an exemplary embodiment is applied to a diffuser portion of the centrifugal compressor 10. FIG. 2 is a schematic perspective view illustrating a front surface side of the variable vane apparatus 100 according to an exemplary embodiment. FIG. 3 is a partially perspective view schematically illustrating a portion of a rear surface side of the variable vane apparatus 100 according to an exemplary embodiment. FIG. 4 is a schematic plan view illustrating an arrangement of a vane gear portion 120, a drive gear portion 140, and a connection gear portion 150 of the variable vane apparatus 100 according to an exemplary embodiment.

Referring to FIGS. 1-4, a centrifugal compressor 10 according to the exemplary embodiment may include an impeller 11 and a diffuser 12. The diffuser 12 may include the variable vane apparatus 100.

Although the variable vane apparatus 100 according to the exemplary embodiment is applied to a centrifugal compressor 10, the inventive concept of the disclosure is not limited thereto. In other words, the variable vane apparatus 100 according to the exemplary embodiment may be widely applied not only to a centrifugal compressor, but also to, for example, blowers, pumps, turbine devices, expanders, turbo chargers, and other turbo devices.

The impeller 11 is rotatably arranged in an inner space of a casing (not shown). A rotary shaft 11*a* of the impeller 11 is coupled to the casing by a mechanical seal (not shown), which prevents leakage of a fluid through a coupling portion between the rotary shaft 11*a* and the casing while the rotary shaft 11*a* is rotatable with respect to the casing.

The impeller 11 may include an impeller vane 11*b* radially arranged with respect to the rotary shaft 11*a*. Accordingly, when the impeller 11 is rotated, an inflowing fluid receives a centrifugal force by the impeller vane 11*b* and is forced to move radially.

The diffuser 12 is arranged around the impeller 11. The fluid that is moved radially by receiving a centrifugal force by the impeller 11 is decelerated by the diffuser 12 and compressed as pressure is increased.

Because the diffuser 12 is a variable diffuser, the diffuser 12 includes the variable vane apparatus 100. The variable vane apparatus 100 is described below.

The variable vane apparatus 100 may include a housing portion 110, a vane gear portion 120, a variable vane portion 130, a drive gear portion 140, a connection gear portion 150, and a drive portion 160.

As illustrated in FIG. 2, the variable vane portion 130 including a plurality of vanes 130 is provided at a front surface side 110*a* of the housing portion 110, and as illustrated in FIG. 3 and FIG. 4, the vane gear portion 120, the drive gear portion 140, and the connection gear portion 150 are provided at a rear surface side 110*b*.

The overall shape of the housing portion 110 is a circular ring, but the exemplary embodiment is not limited thereto. In other words, there is no special limitation to the shape of the housing portion 110 according to an exemplary embodiment.

Furthermore, the housing portion 110 according to the exemplary embodiment is connected to the casing, but the exemplary embodiment is not limited thereto. In other words, a housing portion, for example, may be separately provided without being connected to the casing.

The vane gear portion 120 includes a plurality of vane gear portions 120 provided on the rear surface side 110*b* of the housing portion 110. The vane gear portions 120 are arranged on the housing portion 110 to be rotatably and spaced apart from one another at an interval.

The vane gear portions 120 are provided on the housing portion 110 to be capable of rotating via a vane gear rotary shaft 121. The vane gear rotary shaft 121 may be provided on the housing portion 110 to be capable of rotating by using a bearing structure, for example, a rolling bearing structure, a journal bearing structure, etc.

The vane gear portion 120 is configured by a spur gear having a circular shape.

Although the vane gear portion 120 according to the exemplary embodiment is configured by a spur gear, the inventive concept is not limited thereto. In other words, there is no special limitation to the type of a gear only if the gear enables the vane gear portion 120 according to an exemplary embodiment to be meshed with the drive gear portion 140 and the connection gear portion 150. For example, the vane gear portion 120 according to an exemplary embodiment may be configured by a helical gear, a double-helical gear, etc.

The variable vane portion 130 is provided at the front surface side 110*a* of the housing portion 110, and is connected to the vane gear rotary shaft 121 of the vane gear portion 120.

The drive gear portion 140 transfers power to the vane gear portion 120.

The drive gear portion 140 is provided at the rear surface side 110*b* of the housing portion 110 to be capable of rotating via a drive gear rotary shaft 141. The drive gear rotary shaft 141 may be rotatably provided on the housing portion 110 by using a bearing structure, for example, a rolling bearing structure, a journal bearing structure, etc.

In the exemplary embodiment, the drive gear portion 140 is configured by a spur gear having a circular shape.

Although the drive gear portion 140 according to the exemplary embodiment is configured by a spur gear, this is merely for meshing with the vane gear portion 120 that is configured by a spur gear. If the vane gear portion 120 is configured by a gear of another type, not a spur gear, the drive gear portion 140 may be configured by the type of a gear to be meshed with the vane gear portion 120.

In the case of the variable vane apparatus 100 according to the exemplary embodiment, the drive gear portion 140 includes a single drive gear portion 140, but the inventive concept is not limited thereto. In other words, the drive gear portion 140 according to an exemplary embodiment may include a plurality of drive gear portions 140. In this case, an appropriate control of the rotation direction and rotation speed of the drive gear portion 140 is needed.

The connection gear portion 150 is arranged between the vane gear portions 120 to transfer power between the vane gear portions 120.

The connection gear portion 150 is provided on the rear surface side 110*b* of the housing portion 110 to be capable of rotating via a connection gear rotary shaft 151. The connection gear rotary shaft 151 may be provided on the housing portion 110 to be capable of rotating by using a bearing structure, for example, a rolling bearing structure, a journal bearing structure, etc.

In the exemplary embodiment, the connection gear portion 150 is configured by a spur gear having a circular shape.

Although the connection gear portion 150 according to the exemplary embodiment is configured by a spur gear, this is merely for meshing with the vane gear portion 120 that is configured by a spur gear. If the vane gear portion 120 is configured by a gear of another type, not the spur gear, the connection gear portion 150 may be configured by the type of the gear to be meshed with the vane gear portion 120. Also, the connection gear portion 150 may be configured by a gear having the same shape of the drive gear portion 140.

The vane gear portion 120, the variable vane portion 130, and the connection gear portion 150 according to the exemplary embodiment are arranged in a circumferential direction of the housing portion 110.

The drive portion 160 transfers power to the drive gear portion 140. To this end, the drive portion 160 may include a motor 161 and a decelerator 162.

The motor 161 generates power and various types of motors such as a servo motor, a DC motor, an AC motor, a step motor, etc. may be used.

The decelerator 162 performs functions of increasing a drive torque and lowering a rotational speed while transferring the power generated by the motor 161 to the drive gear portion 140.

The power generated by the motor 161 is transferred to the decelerator 162 via a motor shaft 161*a*, and the power transferred to the decelerator 162 is transferred to the drive gear rotary shaft 141 via a decelerator shaft 162*a*. Thus, the power is transferred to the drive gear portion 140.

Although the drive portion 160 according to the exemplary embodiment includes the motor 161 and the decelerator 162, the inventive concept is not limited thereto. In other words, the drive portion 160 according to an exemplary embodiment may not include at least any one of the motor 161 and the decelerator 162 because the drive portion 160 merely needs to transfer the power to the drive gear portion 140 to rotate the drive gear portion 140. When the drive portion 160 according to an exemplary embodiment does not include the motor 161, the drive portion 160 may have a structure of a power transfer device such as a gear train or a cam assembly that does not directly generate power, but receives power from other drive source of a turbo device to which the variable vane apparatus 100 is applied. Also, the drive portion 160 according to the exemplary embodiment may be configured to have a linear actuator and link structure only if the structure can transfer power to the drive gear portion 140 to rotate the drive gear portion 140. Furthermore, the drive portion 160 according to an exemplary embodiment may have a form of a geared motor in which a motor and a decelerator are combined with each other, or may not include a decelerator when the motor has a high torque.

An operation of the variable vane apparatus 100 according to the exemplary embodiment is described below in detail with reference to FIGS. 5 and 6.

Figure 5:
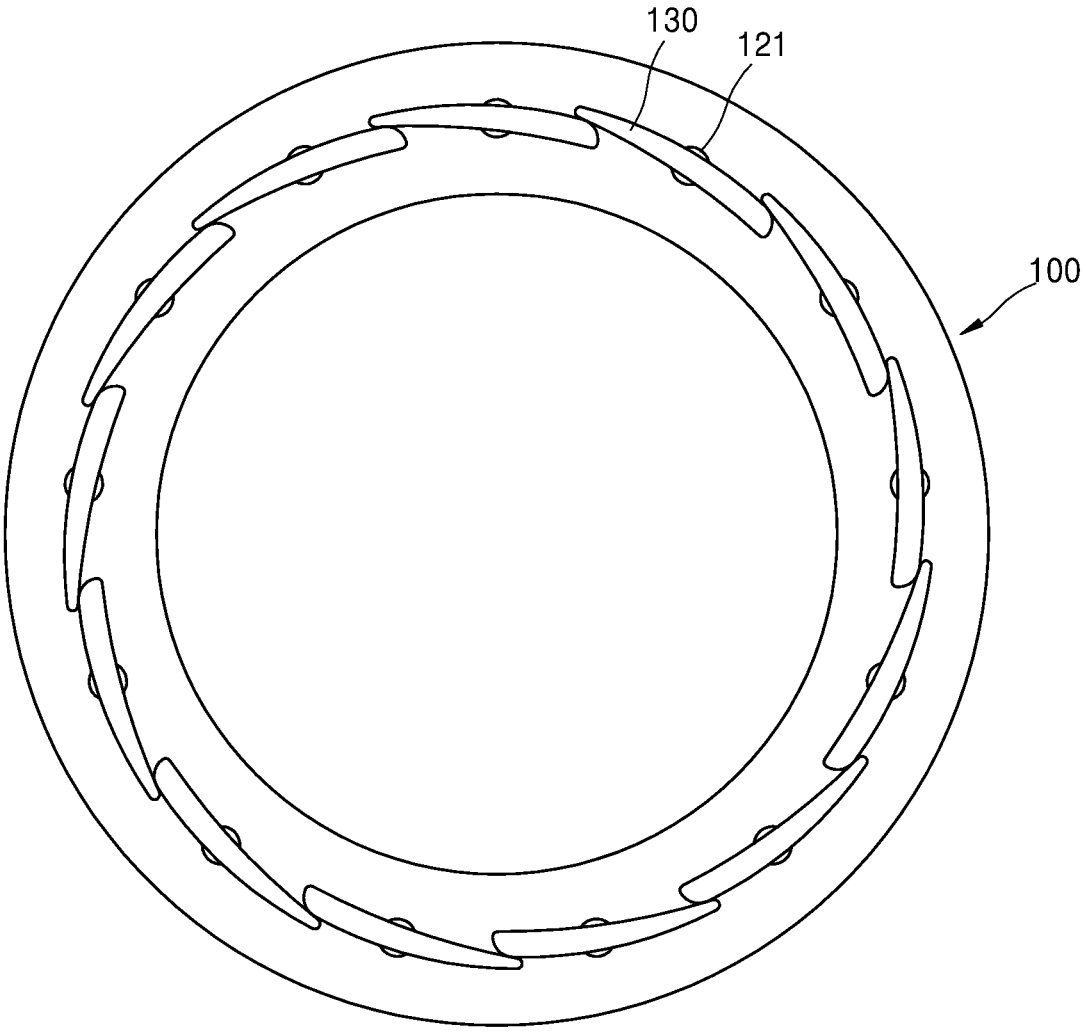
FIG. 5 is a schematic plan view illustrating that the variable vane apparatus is in a closed state, according to an exemplary embodiment.
Figure 6:
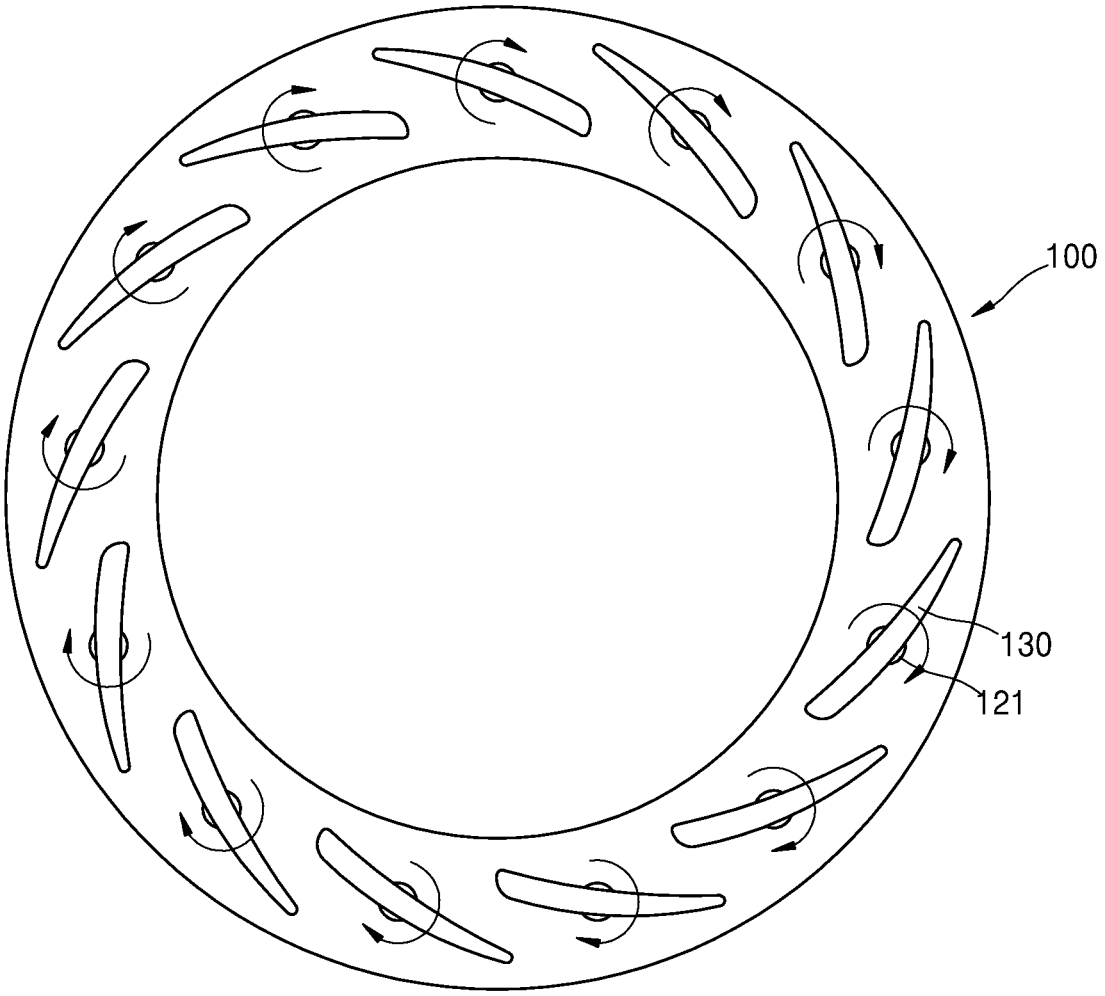
FIG. 6 is a schematic plan view illustrating that the variable vane apparatus is in an open state, according to an exemplary embodiment.

FIG. 5 is a schematic plan view illustrating that a variable vane apparatus 100 is in a closed state, according to an exemplary embodiment. FIG. 6 is a schematic plan view illustrating that a variable vane apparatus 100 is in an open state according to an exemplary embodiment.

As illustrated in FIG. 5, when the variable vane portion 130 overlapping each other is in a closed state, if an operator or an operating system drives the drive portion 160, the motor 161 generates power and the generated power is transferred to the drive gear portion 140 via the decelerator 162.

When the drive gear portion 140 rotates, the vane gear portion 120 meshed with the drive gear portion 140 is rotated, and then the connection gear portion 150 meshed with the vane gear portion 120 is rotated. Because the connection gear portion 150 is meshed with the neighboring vane gear portion 120, when the connection gear portion 150 rotates, the vane gear portion 120 meshed with the connection gear portion 150 is rotated. In such a manner, the vane gear portion 120 and the connection gear portion 150 are rotated along the circumferential direction of the housing portion 110, and thus all of the vane gear portions 120 of the variable vane apparatus 100 are rotated together simultaneously. Then, all of the variable vane portions 130 connected to the vane gear portion 120 are rotated to be in the open state of FIG. 6.

As described above, because the variable vane apparatus 100 according to the exemplary embodiment has a simple structure compared to the variable vane apparatus according to the related art including a ring gear and a plurality of quad gears, installation may be simple, manufacturing costs may be saved, and maintenance and repair may be easy.

Furthermore, because the vane gear portion 120 and the connection gear portion 150 of the variable vane apparatus 100 according to the exemplary embodiment have a circular shape, less load is applied in a radial direction of the vane gear rotary shaft 121 than the variable vane apparatus according to the related art including a ring gear and a plurality of quad gears, durability and life of the variable vane apparatus 100 may be increased.

Furthermore, as the vane gear portion 120 of the variable vane apparatus 100 according to the exemplary embodiment is provided to be meshed with the drive gear portion 140 or the connection gear portion 150, the vane gear portion 120 arranged between the connection gear portions 150 receives a uniform force from the connection gear portions 150 at both sides along the circumferential direction. Then, an eccentric load is not generated in the vane gear rotary shaft 121, generation of abrasion of the vane gear rotary shaft 121 may be reduced and life thereof may be increased.

Furthermore, because the variable vane apparatus 100 according to the exemplary embodiment does not need the ring gear according to the related art, vibration due to the ring gear that is relatively large is not generated, and thus overall vibration and noise is reduced.

As described above, according to the above-described exemplary embodiment, a variable vane apparatus having a simple structure may be provided.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While exemplary embodiments have been described with reference to the figures, it will be understood by those of ordinary skill in the art that various changes in form and details may be made therein without departing from the spirit and scope as defined by the following claims.

What is claimed is:

1. A variable vane apparatus comprising:

a housing portion;

a plurality of vane gear portions configured to rotate and provided on the housing portion to be spaced apart from one another;

a plurality of variable vane portions connected to the plurality of vane gear portions;

a drive gear portion configured to transfer power to the plurality of vane gear portions; and a connection gear portion arranged between the plurality of vane gear portions and configured to transfer power amongst the plurality of vane gear portions, wherein the drive gear portion is arranged between adjacent vane gear portions of the plurality of vane gear portions.

2. The variable vane apparatus of claim 1, wherein the housing portion has a circular ring shape.

3. The variable vane apparatus of claim 2, wherein the plurality of vane gear portions, the plurality of variable vane portions, and the connection gear portion are arranged in a circumferential direction of the housing portion.

4. The variable vane apparatus of claim 1, wherein the plurality of vane gear portions, the drive gear portion, and the connection gear portion are provided at a rear surface side of the housing portion.

5. The variable vane apparatus of claim 1, wherein each of the plurality of vane gear portions is provided on the housing portion via a vane gear rotary shaft.

6. The variable vane apparatus of claim 5, wherein each of the plurality of variable vane portions is provided at a front surface side of the housing portion, and are connected to the vane gear rotary shaft.

7. The variable vane apparatus of claim 1, further comprising a drive portion configured to transfer power to the drive gear portion.

8. The variable vane apparatus of claim 1, wherein each of the plurality of vane gear portions has a circular shape and the connection gear portion has a circular shape.

9. A variable vane apparatus comprising:

a housing portion;

a plurality of variable vanes provided on a first surface of the housing portion and comprising:

a first variable vane;

a second variable vane; and a plurality of vane gears provided on a second surface opposite to the first surface of the housing portion and comprising:

a first vane gear connected to the first variable vane via a first gear rotary shaft;

a second vane gear connected to the second variable vane via a second gear rotary shaft; and a third vane gear connected to the third variable vane via a third gear rotary shaft;

a drive gear connected to the first and second vane gears and configured to transfer power to the first and second vane gears; and a connection gear arranged between the second and third vane gears and configured to transfer power from the second vane gear to the third vane gear, wherein the drive gear is arranged between the first vane gear and the second vane gear.

10. The variable vane apparatus of claim 9, wherein the plurality of vane gears, the plurality of variable vanes, and the connection gear are arranged in a circumferential direction of the housing portion.

11. The variable vane apparatus of claim 9, wherein the first vane gear, the second vane gear, the connection gear and the third vane gear simultaneously rotate in response to rotation of the drive gear.

* * * * *